US011528566B2

(12) United States Patent
Weispfenning et al.

(10) Patent No.: US 11,528,566 B2
(45) Date of Patent: Dec. 13, 2022

(54) BATTERY LIFE ESTIMATION FOR HEARING INSTRUMENTS

(71) Applicant: Starkey Laboratories, Inc., Eden Prairie, MN (US)

(72) Inventors: Michael James Weispfenning, Shakopee, MN (US); Ramsey Albert Statz, Minneapolis, MN (US); Michael James Schmitz, Golden Valley, MN (US); Seyed Alireza Pourbakhsh, Minneapolis, MN (US); Charles William Steidl, Edina, MN (US); Jeffrey Raymond Brooker, Shoreview, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 17/214,193

(22) Filed: Mar. 26, 2021

(65) Prior Publication Data

US 2021/0306764 A1 Sep. 30, 2021

Related U.S. Application Data

(60) Provisional application No. 63/002,867, filed on Mar. 31, 2020.

(51) Int. Cl.
*H04R 25/00* (2006.01)

(52) U.S. Cl.
CPC ..... *H04R 25/30* (2013.01); *H04R 25/554* (2013.01); *H04R 2225/33* (2013.01)

(58) Field of Classification Search
CPC H04R 2225/31; H04R 2225/33; H04R 25/30; H04R 25/554
See application file for complete search history.

(56) References Cited

U.S. PATENT DOCUMENTS

| | | | |
|---|---|---|---|
| 6,711,271 | B2 | 3/2004 | Hou |
| 9,235,704 | B2 | 1/2016 | Wootton et al. |
| 2004/0017180 | A1 | 1/2004 | Cook |

(Continued)

FOREIGN PATENT DOCUMENTS

WO 2011/159349 A1 12/2011

OTHER PUBLICATIONS

"Enhance your performance with Signia Pure," Signia, accessed from https://www.signia.net/en-us/hearing-aids/pure/, accessed on Jul. 6, 2021, 5 pp.

*Primary Examiner* — Sunita Joshi

(74) *Attorney, Agent, or Firm* — Shumaker & Sieffert, P.A.

(57) ABSTRACT

A system may obtain data related to hearing instruments, such as data indicating answers of a user to a questionnaire or historical usage data of the hearing instruments. For each respective feature of one or more features, the system may determine a feature duty cycle corresponding to an amount of time during a period in which the respective feature is anticipated to be active based on the data related to the hearing instruments. The system may further determine an energy cost for the respective feature at least based on the respective feature duty cycle for the respective feature and a power consumption rate of the respective feature. The system may calculate a battery life of one or more batteries in the hearing instruments at least based on the energy costs for each feature of the one or more features.

17 Claims, 4 Drawing Sheets

(56) References Cited

U.S. PATENT DOCUMENTS

| | | | | |
|---|---|---|---|---|
| 2012/0130660 | A1* | 5/2012 | Neumeyer | G01R 31/392<br>320/137 |
| 2017/0230769 | A1* | 8/2017 | Nguyen | H04R 25/70 |
| 2020/0120428 | A1* | 4/2020 | Gehring | H04R 25/554 |

* cited by examiner

BATTERY LIFE ESTIMATION FOR HEARING INSTRUMENTS

This application claims the benefit of U.S. Provisional Patent Application 63/002,867, filed Mar. 31, 2020, the entire content of which is incorporated by reference.

TECHNICAL FIELD

This disclosure relates to hearing instruments.

BACKGROUND

Hearing instruments are devices designed to be worn on, in, or near one or more of a user's ears. Common types of hearing instruments include hearing assistance devices (e.g., "hearing aids"), earbuds, headphones, hearables, cochlear implants, and so on. In some examples, a hearing instrument may be implanted or integrated into a user. Some hearing instruments include additional features beyond just environmental sound-amplification. For example, some modern hearing instruments include advanced audio processing for improved device functionality, controlling and programming the devices, and beamforming, and some can even communicate wirelessly with external devices including other hearing instruments (e.g., for streaming media).

SUMMARY

This disclosure describes techniques for estimating a battery life of one or more batteries in one or more hearing instruments based on data related to the one or more hearing instruments. In this disclosure, systems that are able to automatically determine a feature duty cycle for each respective feature of a set of one or more features of the one or more hearing instruments based on the data related to the one or more hearing instruments are described.

In one example, this disclosure describes a method comprising: obtaining, by a processing system, data related to one or more hearing instruments; for each respective feature of one or more features: determining, by the processing system, a feature duty cycle for the respective feature based on the data related to the one or more hearing instruments, wherein the feature duty cycle for the respective feature corresponds to an amount of time during a period in which the respective feature is anticipated to be active; and determining, by the processing system, an energy cost for the respective feature at least based on the feature duty cycle for the respective feature and a power consumption rate of the respective feature; and calculating, by the processing system, a battery life of one or more batteries in the one or more hearing instruments at least based on the energy costs for each feature of the one or more features.

In another example, this disclosure describes a computing system comprising: one or more devices comprising one or more processors configured to: obtain data related to one or more hearing instruments; for each respective feature of one or more features: determine a feature duty cycle for the respective feature based on the data related to the one or more hearing instruments, wherein the feature duty cycle for the respective feature corresponds to an amount of time during a period in which the respective feature is anticipated to be active; determine, an energy cost for the respective feature at least based on the respective feature duty cycle for the respective feature and a power consumption rate of the respective feature; and calculate a battery life of one or more batteries in the one or more hearing instruments at least based on the energy costs for each feature of the one or more features.

In another example, this disclosure describes a non-transitory computer-readable data storage medium having instructions stored thereon that when executed cause a processing system to: obtain data related to one or more hearing instruments; for each respective feature of one or more features: determine a feature duty cycle for the respective feature based on the data related to the one or more hearing instruments, wherein the feature duty cycle for the respective feature corresponds to an amount of time during a period in which the respective feature is anticipated to be active; and determine an energy cost for the respective feature at least based on the feature duty cycle for the respective feature and a power consumption rate of the respective feature; and calculate a battery life of one or more batteries in the one or more hearing instruments at least based on the energy costs for each feature of the one or more features.

In another example, this disclosure describes a computing system comprising: one or more computing devices, wherein one or more processors and one or more communication units are included in the one or more computing devices, the one or more communication units are configured to communicate with one or more hearing instruments, and the one or more processors are configured to: obtain the data related to one or more hearing instruments; for each respective feature of one or more features: determine a feature duty cycle for the respective feature based on the data related to the one or more hearing instruments, wherein the feature duty cycle for the respective feature corresponds to an amount of time during a period in which the respective feature is anticipated to be active; determine, an energy cost for the respective feature at least based on the respective feature duty cycle for the respective feature and a power consumption rate of the respective feature; and calculate a battery life of one or more batteries in the one or more hearing instruments at least based on the energy costs for each feature of the set of one or more features.

In another example, this disclosure describes a hearing instrument comprising: one or more processors configured to: obtain data related to one or more hearing instruments; for each respective feature of one or more features of the one or more hearing instruments: determine a feature duty cycle for the respective feature based on the data related to the one or more hearing instruments, wherein the feature duty cycle for the respective feature corresponds to an amount of time during a period in which the respective feature is anticipated to be active; determine, an energy cost for the respective feature at least based on the respective feature duty cycle for the respective feature and a power consumption rate of the respective feature; and calculate a battery life of one or more batteries in the one or more hearing instruments at least based on the energy costs for each feature of the one or more features.

The details of one or more aspects of the disclosure are set forth in the accompanying drawings and the description below. Other features, objects, and advantages of the techniques described in this disclosure will be apparent from the description, drawings, and claims.

DETAILED DESCRIPTION

Hearing instruments, such as hearing aids, are developed to enable people to hear things that they otherwise cannot. For example, hearing aids may improve the hearing comprehension of individuals who have hearing loss. Other types of hearing instruments may provide artificial sound to users. One or more batteries may be housed or mounted inside one or more hearing instruments to supply electric power to the hearing instruments. The battery life of the one or more batteries of the hearing instruments may depend upon energy capacity of the one or more batteries, one or more features of the hearing instruments, and a feature duty cycle for each respective feature of the one or more features. The battery life of a battery may be an amount of time that a hearing instrument is able to operate using power from the battery. There may be certain unique challenges associated with determining a feature duty cycle for each respective feature of the one or more features. For instance, some features are designed to benefit specific hearing loss needs or specific user needs, so keeping these features constantly on if they do not match a user's hearing profile or the user's needs is unnecessary and wastes battery power. For example, wirelessly streaming audio data to the hearing instruments from the Internet is a useful feature, but considerably reduces the battery life of the one or more batteries of the hearing instruments. This disclosure describes examples of systems and methods for determining a feature duty cycle for each respective feature of one or more features of one or more hearing instruments, and estimating a battery life of one or more batteries in the one or more hearing instruments based on data related to the one or more hearing instruments.

In some examples, the data related to the one or more hearing instruments may include answers to a questionnaire by a user. By obtaining data indicating the answers of the user, a computing system may automatically determine a feature duty cycle for each respective feature of the one or more features to compensate for the user's hearing loss. In some examples, the data related to the hearing instruments may include historical usage data. By obtaining historical usage data, the computing system may be able to automatically determine a feature duty cycle for each respective feature of the one or more features to reduce consumption of battery power.

Figure 1:
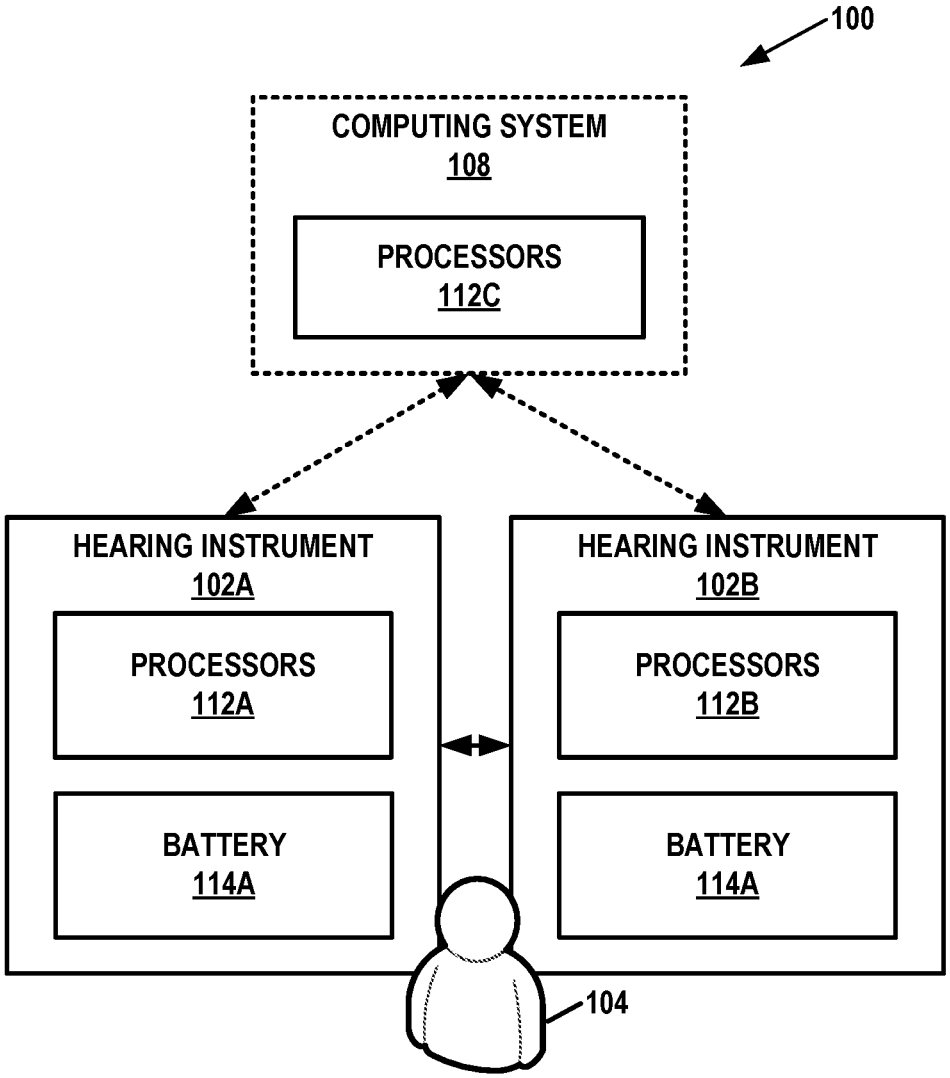
FIG. 1 is a conceptual diagram illustrating an example system that includes one or more hearing instrument(s), in accordance with one or more techniques of this disclosure.

FIG. 1 illustrates an example system 100 for estimating a battery life of one or more batteries in one or more hearing instruments based on data related to the one or more hearing instruments, implemented in accordance with one or more aspects of this disclosure. In the example of FIG. 1, system 100 includes hearing instruments 102A and 102B (collectively, "hearing instruments 102"). A user 104 may wear hearing instruments 102. In some instances, such as when user 104 has unilateral hearing loss, user 104 may wear a single hearing instrument. In other instances, such as when user 104 has bilateral hearing loss, user 104 may wear two hearing instruments, with one hearing instrument for each ear of user 104. However, it should be understood that user 104 may wear a single hearing instrument even if user 104 has bilateral hearing loss.

Hearing instruments 102 may comprise one or more of various types of devices that are configured to provide auditory stimuli to user 104 and that are designed for wear and/or implantation at, on, or near an ear of user 104. Hearing instruments 102 may be worn, at least partially, in the ear canal or concha. One or more of hearing instruments 102 may include behind the ear (BTE) components that are worn behind the ears of user 104. In some examples, hearing instruments 102 comprise devices that are at least partially implanted into or osseointegrated with the skull of user 104. In some examples, one or more of hearing instruments 102 is able to provide auditory stimuli to user 104 via a bone conduction pathway.

In any of the examples of this disclosure, each of hearing instruments 102 may comprise a hearing assistance device. Hearing assistance devices include devices that help user 104 hear sounds in environment of user 104. Example types of hearing assistance devices may include hearing aid devices, Personal Sound Amplification Products (PSAPs), cochlear implant systems (which may include cochlear implant magnets, cochlear implant transducers, and cochlear implant processors), and so on. In some examples, hearing instruments 102 are over-the-counter, direct-to-consumer, or prescription devices. Furthermore, in some examples, hearing instruments 102 include devices that provide auditory stimuli to user 104 that correspond to artificial sounds or sounds that are not naturally in environment of user 104, such as recorded music, computer-generated sounds, or other types of sounds. For instance, hearing instruments 102 may include so-called "hearables," earbuds, earphones, or other types of devices. Some types of hearing instruments provide auditory stimuli to user 104 corresponding to sounds from the environment of user 104 and also artificial sounds.

In some examples, one or more of hearing instruments 102 includes a housing or shell that is designed to be worn in the ear for both aesthetic and functional reasons and encloses the electronic components of the hearing instrument. Such hearing instruments may be referred to as in-the-ear (ITE), in-the-canal (ITC), completely-in-the-canal (CIC), or invisible-in-the-canal (IIC) devices. In some examples, one or more of hearing instruments 102 may be behind-the-ear (BTE) devices, which include a housing worn behind the ear that contains all of the electronic components of the hearing instrument, including the receiver (i.e., the speaker). The receiver conducts sound to an earbud inside the ear via an audio tube. In some examples, one or more of hearing instruments 102 may be receiver-in-canal (MC) hearing-assistance devices, which include a housing worn behind the ear that contains electronic components and a housing worn in the ear canal that contains the receiver.

Hearing instruments 102 may implement a variety of features that help user 104 hear better. For example, hearing instruments 102 may amplify the intensity of incoming sound, amplify the intensity of certain frequencies of the incoming sound, or translate or compress frequencies of the incoming sound. In another example, hearing instruments 102 may implement a directional processing mode in which hearing instruments 102 selectively amplify sound originating from a particular direction (e.g., to the front of user 104) while potentially fully or partially canceling sound originating from other directions. In other words, a directional processing mode may selectively attenuate off-axis unwanted sounds. The directional processing mode may help user 104 understand conversations occurring in crowds or other noisy environments. In some examples, hearing instruments 102 may use beamforming or directional processing cues to implement or augment directional processing modes.

In some examples, hearing instruments 102 may reduce noise by canceling out or attenuating certain frequencies. Furthermore, in some examples, hearing instruments 102 may help user 104 enjoy audio media, such as music or sound components of visual media, by outputting sound based on audio data wirelessly transmitted to hearing instruments 102.

Hearing instruments 102 may be configured to communicate with each other. For instance, in any of the examples of this disclosure, hearing instruments 102 may communicate with each other using one or more wirelessly communication technologies. Example types of wireless communication technology include Near-Field Magnetic Induction (NFMI) technology, a 900 MHz technology, a BLUETOOTH™ technology, a WI-FI™ technology, audible sound signals, ultrasonic communication technology, infrared communication technology, an inductive communication technology, or another type of communication that does not rely on wires to transmit signals between devices. In some examples, hearing instruments 102 use a 2.4 GHz frequency band for wireless communication. In some examples of this disclosure, hearing instruments 102 may communicate with each other via non-wireless communication links, such as via one or more cables, direct electrical contacts, and so on.

As shown in the example of FIG. 1, system 100 may also include a computing system 108. In other examples, system 100 does not include computing system 108. Computing system 108 comprises one or more computing devices, each of which may include one or more processors. For instance, computing system 108 may comprise one or more mobile devices, server devices, personal computer devices, handheld devices, wireless access points, smart speaker devices, smart televisions, medical alarm devices, smart key fobs, smartwatches, smartphones, motion or presence sensor devices, smart displays, screen-enhanced smart speakers, wireless routers, wireless communication hubs, prosthetic devices, mobility devices, special-purpose devices, accessory devices, and/or other types of devices. Accessory devices may include devices that are configured specifically for use with hearing instruments 102. Example types of accessory devices may include charging cases for hearing instruments 102, storage cases for hearing instruments 102, media streamer devices, phone streamer devices, external microphone devices, remote controls for hearing instruments 102, and other types of devices specifically designed for use with hearing instruments 102. Actions described in this disclosure as being performed by computing system 108 may be performed by one or more of the computing devices of computing system 108. One or more of hearing instruments 102 may communicate with computing system 108 using wireless or non-wireless communication links. For instance, hearing instruments 102 may communicate with computing system 108 using any of the example types of communication technologies described elsewhere in this disclosure.

In the example of FIG. 1, hearing instrument 102A includes one or more processors 112A and a battery 114A. Hearing instrument 102B includes one or more processors 112B and a battery 114B. Computing system 106 includes a set of one or more processors 112C. Processors 112C may be distributed among one or more devices of computing system 106. This disclosure may refer to processors 112A, 112B, and 112C collectively as "processors 112." Processors 112 may be implemented in circuitry and may include microprocessors, application-specific integrated circuits, digital signal processors, or other types of circuits. This disclosure may refer to battery 114A and battery 114B collectively as "batteries 114."

As noted above, hearing instruments 102A, 102B, and computing system 106 may be configured to communicate with one another. Accordingly, processors 112 may be configured to operate together as a processing system. Thus, discussion in this disclosure of actions performed by a processing system may be performed by one or more processors in one or more of hearing instrument 102A, hearing instrument 102B, or computing system 106, either separately or in coordination. Moreover, it should be appreciated that, in some examples, the processing system does not include each of processors 112A, 112B, or 112C. For instance, the processing system may be limited to processors 112A and not processors 112B or 112C; or the processing system may include processors 112C and not processors 112A or 112B; or other combinations. Although this disclosure primarily describes computing system 108 as performing actions to determine the battery life of batteries 114, it should be appreciated that such actions may be performed by one or more, or any combination of processors 112, in this processing system.

Components of hearing instrument 102A, including processors 112A, may draw power for battery 114A. Components of hearing instrument 102B, including processors 112B, may draw power for battery 114B. Batteries 114 may be rechargeable batteries, such as lithium-ion batteries, or other types of batteries.

For everyday use, it is important for user 104 to be informed about the expected operating time of hearing instruments 102. To this end, in the example of FIG. 1, computing system 108 may obtain data related to hearing instruments 102 and calculate a battery life of one or more batteries 114 in hearing instruments 102. More specifically, computing system 108 may determine a feature duty cycle for each respective feature of a set of one or more features (e.g., an amount of time during a period in which the feature is anticipated to be active) of hearing instruments 102 and determine an energy cost for the feature at least based on the feature duty cycle for the feature and a power consumption rate of the feature. In some examples, the power consumption rate for a feature is an empirically determined average power consumption rate that occurs in a hearing instrument attributable to use of the feature. Computing system 108 may then calculate the battery life of the one or more batteries 114 in hearing instruments 102 at least based on the energy costs for each feature of the set of one or more features.

In some examples, computing system 108 obtains data indicating answers of user 104 to a questionnaire. User 104 or another user may fill out the questionnaire in a paper form or in a digital form. For instance, in some examples, an application of computing system 108 may output a user interface for display for user 104 or another user. In some examples, the questionnaire may be included in one or more webpages. The user interface may present the questionnaire to user 104 and may receive indications of user input of the answers to the questionnaire. In some examples, user 104 may fill out the questionnaire at home, in a retail store, at a clinician's office, or another type of location.

A clinician may design a particular questionnaire to elicit information from user 104 to determine a set of one or more features of hearing instruments 102 for activation and a duty cycle for the one or more features. In some examples, the questionnaire may include pre-determined questions, which could be used to determine what types of features user 104 would be expected to use and how much time user 104 expects to use the features. For example, the questionnaire may include a series of questions, such as, "How much time do you spend watching television or listening to music each day?," "How much time do you typically spend in noisy places?," "Do you intend to wear your hearing aids part-time or full-time?," and so to determine the types of features user 104 would be expected to use and the amount of time user 104 expect to user 104 expects to use the features.

Responsive to the user input of the answers to the questionnaire, computing system 108 may identify a set of features for activation based on the answers. For example, based on the answers to the questionnaire, computing system 108 may identify an audio output feature of hearing instruments 102 for activation. Based on the answers to the questionnaire, computing system 108 may further determine a feature duty cycle for at least one feature of the set of features. A feature duty cycle for a feature indicates an amount of time during a period in which the respective feature is anticipated to be active. For example, computing system 108 may set the audio output feature to operate throughout the day, such as 16 to 18 hours per day.

For each respective feature of the set of one or more features of hearing instruments 102, computing system 108 may determine an energy cost for the respective feature at least based on the feature duty cycle for the respective feature and a power consumption rate of the respective feature. For instance, if the power consumption rate for a feature (e.g., wirelessly streaming audio data) is P watts and the feature duty cycle for the feature is t hours per day, then the energy cost $E_f$ for the feature may be calculated as $E_f=P\times t$, which represents the energy cost of the feature in watt-hours.

In some examples, a feature may consume power at different rates depending on values of one or more parameters. Example parameters may include noise levels of an acoustic environment, levels of wireless interference, and so on. For example, it may be necessary for a hearing instrument to generate louder audio output if user 104 is in a noisy acoustic environment than if user 104 is in a quiet acoustic environment. Thus, the power consumption rate of an audio amplification feature of a hearing instrument may be greater when user 104 is in a noisy acoustic environment than when user 104 is in a quiet acoustic environment. Thus, in some examples, computing system 108 may treat some features of hearing instruments 102, such an audio amplification feature of hearing instruments 102, as a set of two or more features that correspond to different sets of parameter values. There may be different power consumption rates and duty cycles for each feature in this set of features. For instance, computing system 108 may treat audio amplification in an environment over x decibels as a first feature of hearing instruments 102 and may treat audio amplification in an environment less than or equal to x decibels as a second feature of hearing instruments 102. Accordingly, in this example, the questionnaire may include pre-determined questions designed to assess how much time user 104 expects to spend using features when different parameter values apply. For instance, the questionnaire may include questions designed to assess how much time user 104 expects to spend using the audio amplification feature of hearing instruments 102 in environments that typically have noise levels greater than x decibels and in environments that typically have less than x decibels. Alternatively, in some examples, computing system 108 may determine an energy cost for a feature of hearing instruments 102 as a sum of elements, where each element is power consumption rate for a set of parameter values and a duty cycle for the set of parameter values.

In some examples, computing system 108 determines a power consumption rate for a feature based on an audiogram of user 104. Computing system 108 may determine the power consumption rate for the feature from a set of predetermined power consumption rates or may calculate the power consumption rates based on a predetermined set of one or more formulas. The audiogram of user 104 may characterize the hearing loss of user 104. Users with more profound hearing loss typically require greater amplification of sound in order to perceive the sound. Greater amplification of sound requires greater consumption of electrical power. Accordingly, computing system 108 may be configured with different power consumption rates for specific features for different audiograms. For instance, use of a music streaming feature of hearing instruments 102 may be associated with a power consumption rate of x for users with a first category of audiogram and a power consumption rate of y for users with a second, different category of audiogram. Computing system 108 may receive an indication of the audiogram or category of the audiogram as an answer to one or more questions of the questionnaire or may receive the indication of the audiogram separately from the questionnaire.

Based on the energy costs of the identified features of hearing instruments 102, computing system 108 may calculate the battery life of the one or more batteries 114 in hearing instruments 102. For instance, to calculate the battery life of the one or more batteries, computing system 108 may determine an energy cost for a hearing instrument (e.g., one of hearing instruments 102) and an amount of remaining energy for the one or more batteries. Computing system 108 may determine the energy cost for the hearing instrument by adding up the energy costs of the identified features of hearing instruments 102. In some examples, the energy cost for the hearing instrument may also include an energy cost associated with background operations of the hearing instrument that are not associated with any specific feature. In some examples, the remaining energy for the one or more batteries is the amount of energy that can be stored in the one or more batteries when the one or more batteries are fully charged. In other examples, the remaining energy for the one or more batteries may be an amount of energy less than the amount of energy that can be stored in the one or more batteries when the one or more batteries are fully charged. For instance, if the remaining energy stored in the one or more batteries is R watt-hours and the energy cost of the hearing instrument is $E_s$ watt-hours per day, then the battery life T of the one or more batteries in the hearing instrument may be calculated as $T=R/E_s$, which represents the battery life of the one or more batteries in the hearing instrument in days.

The calculated battery life of the one or more batteries 114 in hearing instruments 102 may help a hearing professional or user 104 to understand if he or she is choosing a product with an appropriately sized battery to achieve the desired battery life, and may help the hearing professional coach user 104 to understand the impact the features have on battery life of the one or more batteries 114 in hearing instruments 102. Furthermore, in some examples, the calculated battery life of the one or more batteries 114 in hearing instruments 102 may help the hearing professional decide which features to enable or disable, or to help the hearing professional determine hearing instrument that has an appropriate set of features of user 104. In some examples, hearing instruments 102 may be over-the-counter hearing instruments (e.g., over-the-counter hearing aids) and user 104 may complete the questionnaire as part of a process of shopping for over-the-counter hearing instruments. Thus, in examples where user 104 is shopping for over-the-counter hearing instruments, user 104 may be able to compare different over-the-counter hearing instrument models based on the user's expected feature usage.

Furthermore, in some examples, computing system 108 may generate and present power consumption reports to user 104. These reports may include raw data logs of hearing instruments 102, statistics calculated from these raw data logs, and different representations that enable user 104 to better visualize the power consumptions of various features of hearing instruments 102. In some examples, the power consumption reports may include a segmented pie chart. For example, the pie chart may be divided into a number of segments reflecting the number of identified features. For each feature of the identified feature, the feature usage data of the respective features may be used to determine the area of the respective segment that represent the respective feature. As another example, the power consumption reports may include a bar chart. A solid portion of the bar may indicate the remaining energy for the one or more batteries 114 of hearing instruments 102, while an open portion of the bar may indicate used energy for the one or more batteries 114 of hearing instruments 102. In some examples, the power consumption reports may include information such as a numerical value of each feature's power consumption, the calculated battery life of the one or more batteries 114 in hearing instruments 102, or any other suitable information. In addition, the calculated battery life may be represented as ranges in order to accommodate margins of error. In some examples, user 104 may select one or more power consumption reports for display. Selecting the one or more power consumption reports may allow user 104 to understand the energy usage of each feature and understand how he or she could change his or her behavior or choose to disable certain features in order to achieve a desired battery life.

User 104 may adjust the initial feature settings to meet the preferences of user 104, which may affect the operating time of hearing instruments 102. To accurately estimate the operating time of hearing instruments 102, computing system 108 may obtain historical usage data of hearing instruments 102 from hearing instruments 102. In some examples, hearing instruments 102 may store historical usage data in memory storage and may transmit historical usage data from hearing instruments 102 to computing system 108. For example, in some instances, a communication unit of hearing instruments 102 may communicate with computing system 108, which allows computing system 108 to use historical usage data of hearing instruments 102 to identify a set of features and to determine a feature duty cycle for at least one feature of the set of features.

Examples of historical usage data of hearing instruments 102 may include any data related to the usage of hearing instruments 102, such as, but not limited to, data logs of hearing instruments 102, status of hearing instruments 102, remaining energy for the one or more batteries 114 in hearing instruments 102, or other suitable data. In some examples, data logs of hearing instruments 102 may include feature usage data, such as, but not limited to, usage data of photoplethysmography (PPG) sensing, step counting, body temperature measuring, sleep tracking, binaural noise cancelation, directional processing, media streaming, wireless remote microphone, environment classifier, acoustic input levels, acoustic output levels, fall detection, user control configuration, mobile app connectivity, etc. In this way, hearing instruments 102 may provide information to computing system 108 to allow computing system 108 to determine duty cycles for features of hearing instruments 102. Additionally, computing system 108 may use the information provided by hearing instruments 102 to present information that allows user 104 to track his or her energy usage, manage and improve control of his or her energy usage and power consumption, allocate costs to specific features, and improve battery life of the one or more batteries 114 in hearing instruments 102.

In some examples, computing system 108 provides a user interface to allow user 104 to provide a user input to update the feature duty cycle for the respective feature of one or more features. Responsive to the user input, computing system 108 may generate an updated energy cost for hearing instruments 102 based at least in part on the updated feature duty cycle for the respective feature and the power consumption rate of the respective feature. Computing system 108 may then calculate an updated battery life of the one or more batteries 114 in hearing instruments 102 based at least in part on the updated energy cost for each feature of the one or more features. In some examples, the power consumption report may include the updated battery life. User 104 may adjust various features based on the power consumption report to more optimally improve the battery life of the one or more batteries 114 in hearing instruments 102. For instance, responsive to the user input, computing system 108 may instruct hearing instruments 102 to activate or deactivate specific features. For example, user 104 may provide a user input to deactivate a wirelessly streaming audio data feature of hearing instruments 102. In this way, computing system 108 may provide feedback about how various features are affecting battery life.

In some examples, computing system 108 may instruct hearing instruments 102 to enter a power conservation mode when the battery life of the one or more batteries 114 in one or more of hearing instruments 102 is below a threshold battery life. For instance, in response to determining that the battery life of the one or more batteries 114 in a hearing instrument is below a threshold battery life, computing system 108 may automatically disable one or more of the features in order to maximize the remaining battery life of the one or more batteries 114 in the hearing instrument.

In some examples, computing system 108 may provide low battery notifications to user 104 and/or a third-party. Computing system 108 may generate such low battery notifications when the battery life of one or more of batteries 114 of hearing instruments 102 is below a threshold value. Computing system 108 may generate a low battery notification in various ways. For example, computing system 108 may cause a computing device (e.g., computing device 300, or other computing devices, etc.) to display notification messages, output sounds, display text or graphics in a GUI, or otherwise provide information that notifies user 104 of hearing instruments 102 or a third-party to indicate the battery life of one or more of batteries 114 is below the threshold value. In some examples, alerts to one or more of user 104 and a third-party may be generated in the cloud and then communicated using any suitable technique or techniques (e.g., electronic mail notification, short message service (SMS) notification, phone notification, audio notification through hearing instruments 102, etc.).

Figure 2:
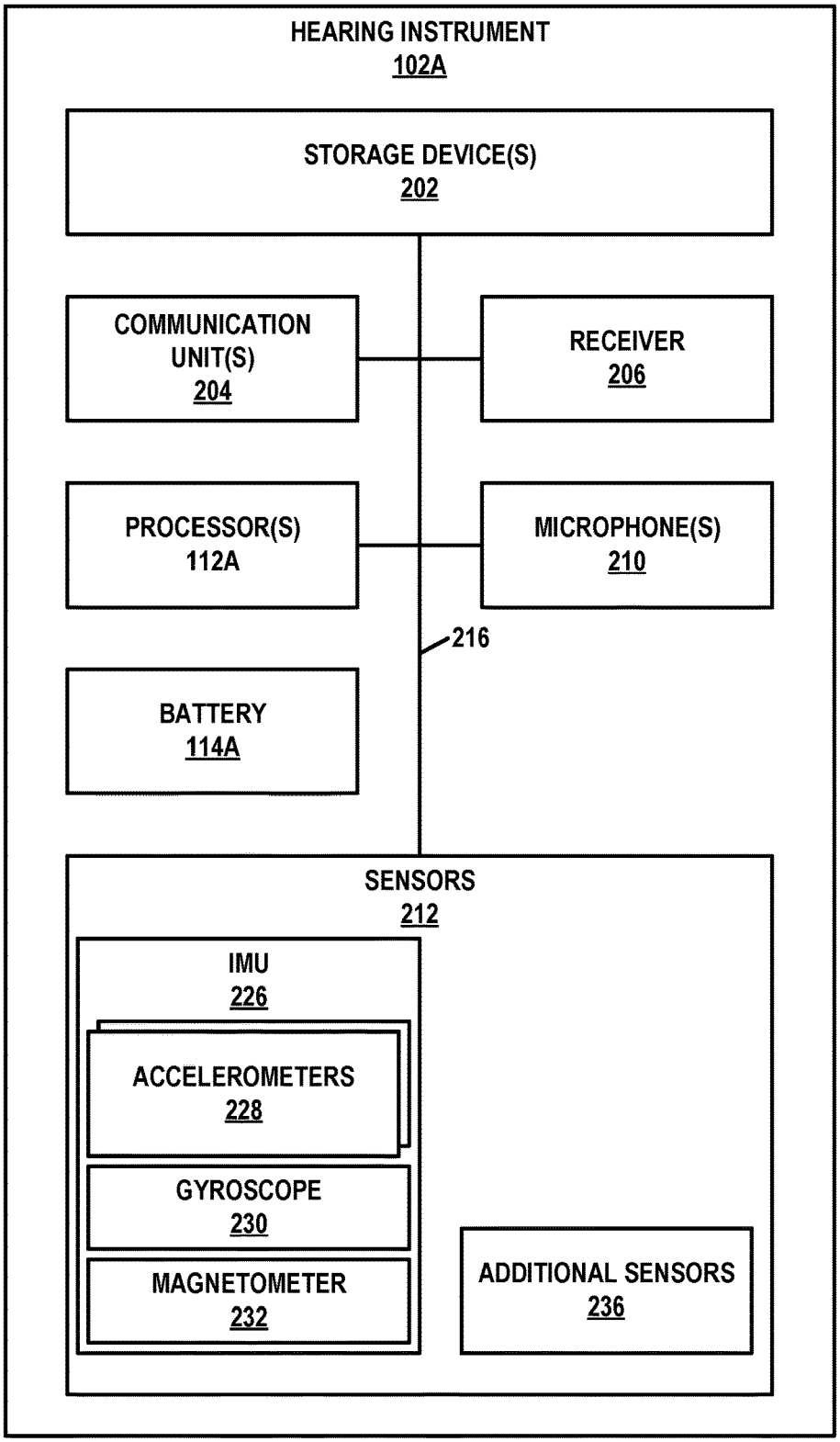
FIG. 2 is a block diagram illustrating example components of a hearing instrument, in accordance with one or more aspects of this disclosure.

FIG. 2 is a block diagram illustrating example components of hearing instrument 102A, in accordance with one or more aspects of this disclosure. Hearing instrument 102B may include the same or similar components of hearing instrument 102A shown in the example of FIG. 2. Thus, discussion of hearing instrument 102A may apply with respect to hearing instrument 102B.

In the example of FIG. 2, hearing instrument 102A comprises one or more storage devices 202, one or more communication units 204, a receiver 206, one or more processors 112A, one or more microphones 210, a set of sensors 212, a battery 114A, and one or more communication channels 216. Communication channels 216 provide communication between storage devices 202, communication unit(s) 204, receiver 206, processor(s) 112A, a microphone(s) 210, and sensors 212. Components 202, 204, 206, 112A, 210, and 212 may draw electrical power from battery 114A.

Battery 114A may include any suitable arrangement of disposable batteries, along or in combination with rechargeable batteries, to provide electric power to storage devices 202, communication units 204, receiver 206, processors 112A, microphones 210, and sensors 212.

In the example of FIG. 2, each of components 202, 204, 206, 112A, 210, 212, 114A, and 216 are contained within a single housing 218. However, in other examples of this disclosure, components 202, 204, 206, 112A, 210, 212, 114A, and 216 may be distributed among two or more housings. For instance, in an example where hearing instrument 102A is a RIC device, receiver 206 and one or more of sensors 212 may be included in an in-ear housing separate from a behind-the-ear housing that contains the remaining components of hearing instrument 102A. In such examples, a RIC cable may connect the two housings.

Furthermore, in the example of FIG. 2, sensors 212 include an inertial measurement unit (IMU) 226 that is configured to generate data regarding the motion of hearing instrument 102A. IMU 226 may include a set of sensors. For instance, in the example of FIG. 2, IMU 226 includes one or more of accelerometers 228, a gyroscope 230, a magnetometer 232, combinations thereof, and/or other sensors for determining the motion of hearing instrument 102A. Furthermore, in the example of FIG. 2, hearing instrument 102A may include one or more additional sensors 236. Additional sensors 236 may include a photoplethysmography (PPG) sensor, blood oximetry sensors, blood pressure sensors, electrocardiograph (EKG) sensors, body temperature sensors, electroencephalography (EEG) sensors, environmental temperature sensors, environmental pressure sensors, environmental humidity sensors, skin galvanic response sensors, and/or other types of sensors. In other examples, hearing instrument 102A and sensors 212 may include more, fewer, or different components.

Storage devices 202 may store data. Storage devices 202 may comprise volatile memory and may therefore not retain stored contents if powered off. Examples of volatile memories may include random access memories (RAM), dynamic random access memories (DRAM), static random access memories (SRAM), and other forms of volatile memories known in the art. Storage devices 202 may further be configured for long-term storage of information as non-volatile memory space and may retain information after power on/off cycles. Examples of non-volatile memory configurations may include magnetic hard discs, optical discs, floppy discs, flash memories, or forms of electrically programmable memories (EPROM) or electrically erasable and programmable (EEPROM) memories.

Communication unit(s) 204 may enable hearing instrument 102A to send data to and receive data from one or more other devices, such as another hearing instrument, an accessory device, a mobile device, or another type of device. Communication unit(s) 204 may enable hearing instrument 102A to communicate using wireless or non-wireless communication technologies. For instance, communication unit (s) 204 enable hearing instrument 102A to communicate using one or more of various types of wireless technology, such as a BLUETOOTH™ technology, 3G, 4G, 4G LTE, 5G, ZigBee, WI-FI™, Near-Field Magnetic Induction (NFMI), ultrasonic communication, infrared (IR) communication, or another wireless communication technology. In some examples, communication unit(s) 204 may enable hearing instrument 102A to communicate using a cable-based technology, such as a Universal Serial Bus (USB) technology.

Receiver 206 comprises one or more speakers for generating audible sound. Microphone(s) 210 detects incoming sound and generates one or more electrical signals (e.g., an analog or digital electrical signal) representing the incoming sound.

Processor(s) 112A may be processing circuits configured to perform various activities. For example, processor(s) 112A may process the signal generated by microphone(s) 210 to enhance, amplify, or cancel-out particular channels within the incoming sound. Processor(s) 112A may then cause receiver 206 to generate sound based on the processed signal. In some examples, processor(s) 112A include one or more digital signal processors (DSPs). In some examples, processor(s) 112A may cause communication unit(s) 204 to transmit one or more of various types of data. For example, processor(s) 112A may cause communication unit(s) 204 to transmit data to computing system 108. Furthermore, communication unit(s) 204 may receive audio data from computing system 108 and processor(s) 112A may cause receiver 206 to output sound based on the audio data.

Figure 3:
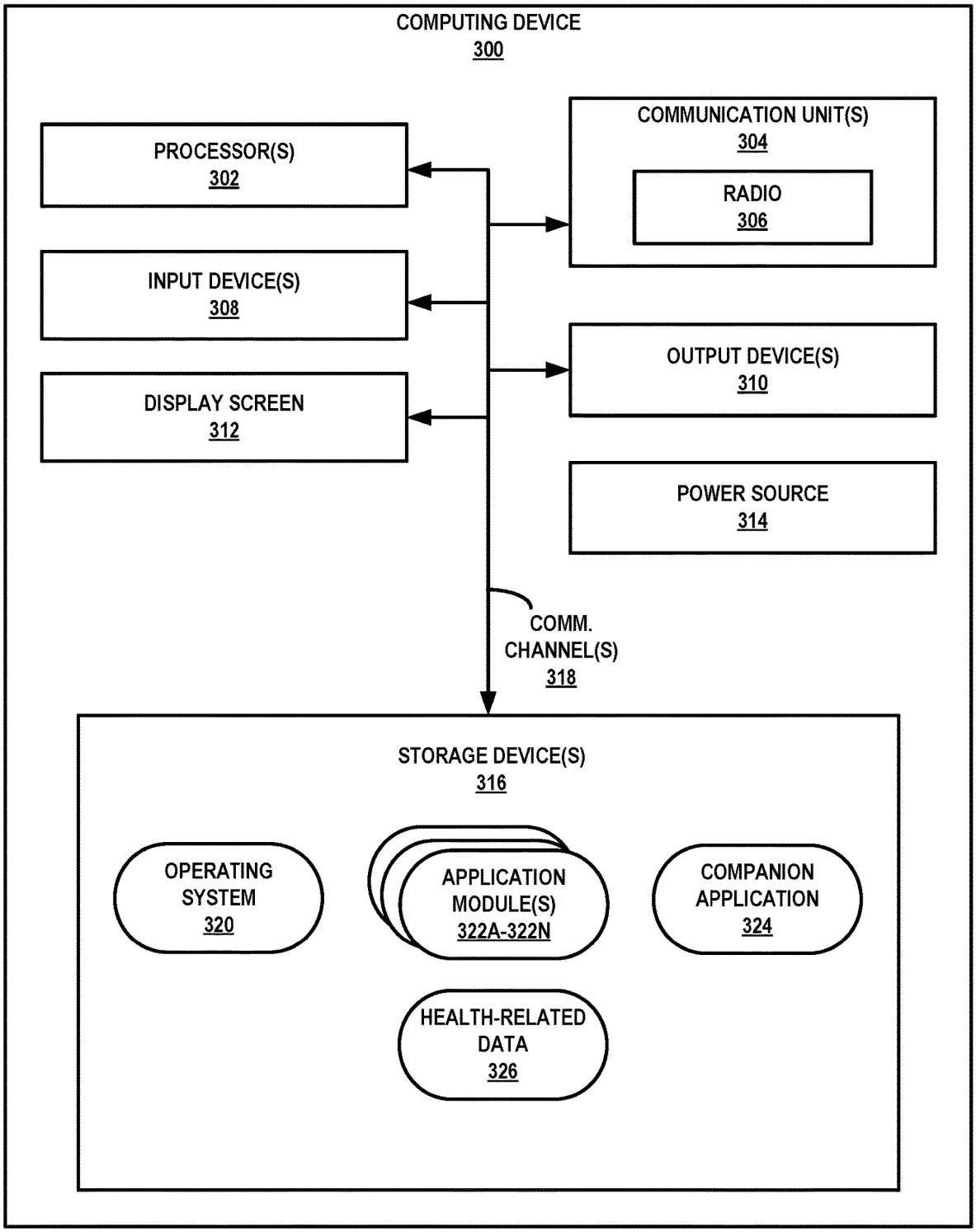
FIG. 3 is a block diagram illustrating example components of a computing device, in accordance with one or more aspects of this disclosure.

FIG. 3 is a block diagram illustrating example components of computing device 300, in accordance with one or more aspects of this disclosure. FIG. 3 illustrates only one particular example of computing device 300, and many other example configurations of computing device 300 exist. Computing device 300 may be a computing device in computing system 108 (FIG. 1).

As shown in the example of FIG. 3, computing device 300 includes one or more processor(s) 302, one or more communication unit(s) 304, one or more input device(s) 308, one or more output device(s) 310, a display screen 312, a power source 314, one or more storage device(s) 316, and one or more communication channels 318. Processors 112C (FIG. 1) may include processor(s) 302. Computing device 300 may include other components. For example, computing device 300 may include physical buttons, microphones, speakers, communication ports, and so on. Communication channel(s) 318 may interconnect each of components 302, 304, 308, 310, 312, and 316 for inter-component communications (physically, communicatively, and/or operatively). In some examples, communication channel(s) 318 may include a system bus, a network connection, an inter-process communication data structure, or any other method for communicating data. Power source 314 may provide electrical energy to components 302, 304, 308, 310, 312 and 316.

Storage device(s) 316 may store information required for use during operation of computing device 300. In some examples, storage device(s) 316 have the primary purpose of being a short term and not a long-term computer-readable storage medium. Storage device(s) 316 may be volatile memory and may therefore not retain stored contents if powered off. Storage device(s) 316 may further be configured for long-term storage of information as non-volatile memory space and may retain information after power on/off cycles. In some examples, processor(s) 302 of computing device 300 may read and execute instructions stored by storage device(s) 316.

Computing device 300 may include one or more input device(s) 308 that computing device 300 uses to receive user input. Examples of user input include tactile, audio, and video user input. Input device(s) 308 may include presence-sensitive screens, touch-sensitive screens, mice, keyboards, voice responsive systems, microphones or other types of devices for detecting input from a human or machine.

Communication unit(s) 304 may enable computing device 300 to send data to and receive data from one or more other computing devices (e.g., via a communications network, such as a local area network or the Internet). For instance, communication unit(s) 304 may be configured to receive data exported by hearing instrument(s) 102, receive data generated by user 104 of hearing instrument(s) 102, receive and send request data, receive and send messages, and so on. In some examples, communication unit(s) 304 may include wireless transmitters and receivers that enable computing device 300 to communicate wirelessly with the other computing devices. For instance, in the example of FIG. 3, communication unit(s) 304 include a radio 306 that enables computing device 300 to communicate wirelessly with other computing devices, such as hearing instruments 102 (FIG. 1). Examples of communication unit(s) 304 may include network interface cards, Ethernet cards, optical transceivers, radio frequency transceivers, or other types of devices that are able to send and receive information. Other examples of such communication units may include BLUETOOTH™, 3G, 4G, 5G, and WI-FI™ radios, Universal Serial Bus (USB) interfaces, etc. Computing device 300 may use communication unit(s) 304 to communicate with one or more hearing instruments (e.g., hearing instruments 102 (FIG. 1, FIG. 2)). Additionally, computing device 300 may use communication unit(s) 304 to communicate with one or more other remote devices.

Output device(s) 310 may generate output. Examples of output include tactile, audio, and video output. Output device(s) 310 may include presence-sensitive screens, sound cards, video graphics adapter cards, speakers, liquid crystal displays (LCD), or other types of devices for generating output.

Processor(s) 302 may read instructions from storage device(s) 316 and may execute instructions stored by storage device(s) 316. Execution of the instructions by processor(s) 302 may configure or cause computing device 300 to provide at least some of the functionality ascribed in this disclosure to computing device 300. As shown in the example of FIG. 3, storage device(s) 316 include computer-readable instructions associated with operating system 320, application modules 322A-322N (collectively, "application modules 322"), and a companion application 324. Additionally, in the example of FIG. 3, storage device(s) 316 may store health-related data 326.

Execution of instructions associated with operating system 320 may cause computing device 300 to perform various functions to manage hardware resources of computing device 300 and to provide various common services for other computer programs. Execution of instructions associated with application modules 322 may cause computing device 300 to provide one or more of various applications (e.g., "apps," operating system applications, etc.). Application modules 322 may provide particular applications, such as text messaging (e.g., SMS) applications, instant messaging applications, email applications, social media applications, text composition applications, and so on.

Execution of instructions associated with companion application 324 by processor(s) 302 may cause computing device 300 to perform one or more of various functions. Companion application 324 may be used as a companion to hearing instruments 102. In some examples, execution of instruments associated with companion application 324 may cause computing device 300 to display a digital questionnaire for user 104 and user 104 may complete the digital questionnaire within application 324. As another example, user 104 may complete a paper-and-pencil questionnaire and then enter the results into companion application 324. In other examples, the questionnaire may be presented by a fitting software system during a process of selecting and setting hearing instruments 102. In some examples, execution of instructions associated with companion application 324 may cause computing device 300 to configure communication unit(s) 304 to receive data from hearing instruments 102 and use the received data to present data illustrating an estimation of battery life of hearing instruments 102 to a user, such as user 104 or a third-party user. The estimation of the battery life of hearing instruments 102 may be presented by companion application 324, which is used by user 104 of hearing instruments 102, which may be a different software from the fitting software. In some examples, companion application 324 is an instance of a web application or server application. In some examples, such as examples where computing device 300 is a mobile device or other type of computing device, companion application 324 may be a native application.

Figure 4:
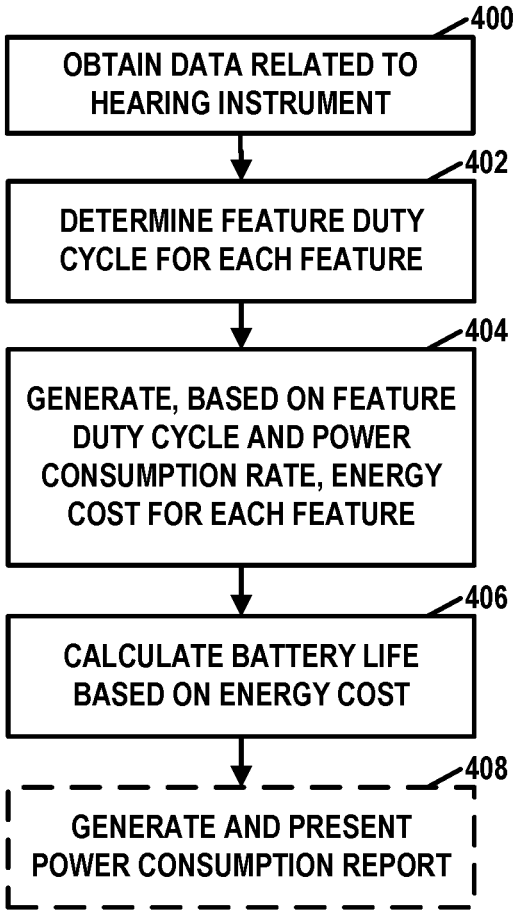
FIG. 4 is a flowchart illustrating an example operation in accordance with one or more aspects of this disclosure.

FIG. 4 is a flowchart illustrating an example operation of a processing system for estimating a battery life of battery 114A of hearing instrument 102A based on data related to hearing instrument 102A, in accordance with one or more techniques of this disclosure. FIG. 4 is provided as an example. Other examples may include more, fewer, or different actions; or actions may be performed in different orders or in parallel. Although the example of FIG. 4 is discussed with respect to hearing instrument 102A, it is to be understood that FIG. 4 may be equally applicable to hearing instrument 102B. Thus, discussion in FIG. 4 of hearing instrument 102A may apply to hearing instrument 102A, hearing instrument 102B, or both hearing instruments 102A and 102B. The operation of FIG. 4 may be performed separately for each of hearing instruments 102A and 102B. In other examples, computing system 108 may impute the calculated battery life of battery 114A of hearing instrument 102A to battery 114B of hearing instrument 102A. In accordance with a technique of this disclosure, computing system 108 may use data related to hearing instrument 102A to calculate a battery life of battery 114A of hearing instrument 102A.

In the example of FIG. 4, computing system 108 may obtain data related to hearing instrument 102A (400). For instance, in some examples, the data related to hearing instrument 102A indicates answers of user 104 to a questionnaire. Thus, in such examples, computing system 108 may obtain data indicating the answers of user 104 to the questionnaire. In some examples, the data related to hearing instrument 102A includes historical usage data of hearing instrument 102A. Thus, in some examples, computing system 108 may obtain historical usage data of hearing instrument 102A.

Computing system 108 may determine a feature duty cycle for each respective feature of one or more features of hearing instrument 102A based on the obtained data (404). The feature duty cycle indicates an amount of time during a period in which the feature is anticipated to be active. In one example, computing system 108 may determine a feature duty cycle for each respective feature of the one or more features for activation based on the answers of user 104 to the questionnaire. For example, the questionnaire may include a question that asks about an expected amount of time that user 104 expects to listen to music during a day. In this example, if the answer is 30 minutes, computing system 108 sets the feature duty cycle for the music streaming feature to 30 minutes. In another example, computing system 108 may determine a feature duty cycle for each respective feature of the one or more features based on historical usage data. For example, computing system 108 or hearing instruments 102 may monitor the feature usage time of each respective feature of the one or more features over a time period and calculate a feature duty cycle based on the feature usage time and the time period. For instance, if the feature usage time of a certain feature is Y minutes over X days, then the feature duty cycle P of the feature may be calculated as P=Y/X, which represents the feature has a P minutes per day feature duty cycle. In some examples, the historical usage data of hearing instrument 102A may be used with the answers of user 104 to the questionnaire to more accurately estimate the battery life of battery 114A of hearing instrument 102A.

In some examples, computing system 108 may separately identify the one or more features based on the obtained data. For instance, in some examples, computing system 108 may identify one or more features for activation based on the answers of user 104 to the questionnaire. In some examples, computing system 108 may identify the one or more features based on historical usage data of hearing instrument 102A. In other examples, computing system 108 may determine, based on the obtained data, that the duty cycle for a feature is 0 if user 104 does not expect to use the feature or if user 104 does not use the feature.

For each respective feature of the one or more features of hearing instrument 102A, computing system 108 may determine an energy cost using a power consumption rate of the respective feature and the feature duty cycle for the respective feature (404). For instance, an energy cost for a feature may be calculated as $E_f=P\times t$, where P represents the power consumption rate for the feature in watts, t represents the feature duty cycle for the feature in hours per day, and $E_f$ represents the energy cost for the feature in watt-hours per day. In some examples, computing system 108 may determine the power consumption rate for the feature based on a volume level or other factors. For instance, computing system 108 may display a questionnaire that includes questions regarding amounts of time that user 104 expects to spend in different acoustic environments. In some examples, computing system 108 may determine the amounts of time user 104 spends in different acoustic environments based on real historical data for user 104. For example, computing system 108 may monitor historical volume levels for user 104. Computing system 108 may determine the energy cost of a feature for the different acoustic environments. In some of the examples, computing system 108 may associate a weight factor W with each volume level, and the energy cost of the feature may be calculated as $E_f=\Sigma_{i=0}^{n}P_i\times t_i$, where $E_f$ represents the energy cost for the feature in watt-hours per day, i is an index for different acoustic environments, $P_i$ is a power consumption rate for feature f in acoustic environment i in watts, and $t_i$ is an expected amount of time that feature f will be used in acoustic environment i in hours.

Based on the energy costs for the features of hearing instrument 102A, computing system 108 may calculate a battery life of battery 114A of hearing instrument 102A (406). In some examples, computing system 108 may determine an energy cost for hearing instrument 102A by adding up the energy costs of the features of hearing instrument 102A. Computing system 108 may then calculate the battery life of battery 114A of hearing instrument 102A based on the energy stored by battery 114A and the energy cost for hearing instrument 102A. For instance, the battery life of battery 114A of hearing instrument 102A may be calculated as $T=R/E_s$, where T represents the battery life of battery 114A of hearing instrument 102A in days, R represents the energy stored by battery 114A in watt-hours, and $E_s$ represents the energy cost of hearing instrument 102A in watts-hours per day.

Furthermore, computing system 108 may generate and present a power consumption report (408). In some examples, computing system 108 may receive a user input from user 104 indicating an updated feature duty cycle for a particular feature. Responsive to the user input, computing system 108 may generate an updated energy cost for hearing instrument 102A at least based on the updated feature duty cycle for the particular feature and the power consumption rate of the particular feature. Computing system 108 may then calculate an updated battery life of battery 114A of hearing instrument 102A at least based on the updated energy cost for the particular feature. In some examples, the power consumption report may include the updated battery life, which provides user 104 an estimated battery life of battery 114A based on the expected feature duty cycle for the particular feature.

Additionally, computing system 108 may generate a notification to notify user 104 that the battery life of battery 114A of hearing instrument 102A is below a threshold value. For example, computing system 108 may generate a low battery notification message that includes tips on how to improve the battery life of battery 114A of hearing instrument 102A.

In this disclosure, ordinal terms such as "first," "second," "third," and so on, are not necessarily indicators of positions within an order, but rather may be used to distinguish different instances of the same thing. Examples provided in this disclosure may be used together, separately, or in various combinations. Furthermore, with respect to examples involving personal data regarding a user, it may be required such personal data only be used with the permission of the user.

Depending on the example, it is to be recognized certain acts or events of any of the techniques described herein may be performed in a different sequence, may be added, merged, or left out altogether (e.g., not all described acts or events are necessary for the practice of the techniques). Moreover, in certain examples, acts or events may be performed concurrently, e.g., through multi-threaded processing, interrupt processing, or multiple processors, rather than sequentially.

In one or more examples, the functions described may be implemented in hardware, software, firmware, or any combination thereof. If implemented in software, the functions may be stored on or transmitted over, as one or more instructions or code, a computer-readable medium and executed by a hardware-based processing unit. Computer-readable media may include computer-readable storage media, which corresponds to a tangible medium such as data storage media, or communication media including any medium facilitating transfer of a computer program from one place to another, e.g., according to a communication protocol. In this manner, computer-readable media generally may correspond to (1) tangible computer-readable storage media which is non-transitory or (2) a communication medium such as a signal or carrier wave. Data storage media may be any available media accessible by one or more computers or one or more processing circuits to retrieve instructions, code and/or data structures for implementation of the techniques described in this disclosure. A computer program product may include a computer-readable medium.

By way of example, and not limitation, such computer-readable storage media may comprise RAM, ROM, EEPROM, CD-ROM or other optical disk storage, magnetic disk storage, or other magnetic storage devices, flash memory, cache memory, or any other medium able to be used to store desired program code in the form of instructions or data structures and may be accessed by a computer. Also, any connection is properly termed a computer-readable medium. For example, if instructions are transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. It should be understood, however, computer-readable storage media and data storage media do not include connections, carrier waves, signals, or other transient media, but are instead directed to non-transient, tangible storage media. Disk and disc, as used herein, includes compact disc (CD), laser disc, optical disc, digital versatile disc (DVD), and Blu-ray disc, where disks usually reproduce data magnetically, while discs reproduce data optically with lasers. Combinations of the above should also be included within the scope of computer-readable media.

Functionality described in this disclosure may be performed by fixed function and/or programmable processing circuitry. For instance, instructions may be executed by fixed function and/or programmable processing circuitry. Such processing circuitry may include one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some respects, the functionality described herein may be provided within dedicated hardware and/or software modules. Also, the techniques may be fully implemented in one or more circuits or logic elements. Processing circuits may be coupled to other components in various ways. For example, a processing circuit may be coupled to other components via an internal device interconnect, a wired or wireless network connection, or another communication medium.

The techniques of this disclosure may be implemented in a wide variety of devices or apparatuses, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a hardware unit or provided by a collection of interoperative hardware units, including one or more processors as described above, in conjunction with suitable software and/or firmware.

Various examples have been described. These and other examples are within the scope of the following claims.

What is claimed is:

1. A method comprising:

obtaining, by a processing system, data related to one or more hearing instruments, wherein obtaining data related to the one or more hearing instruments includes obtaining, by the processing system, data indicating answers of a user of the one or more hearing instruments to a questionnaire;

for each respective feature of one or more features:

determining, by the processing system, a feature duty cycle for the respective feature based on the data related to the one or more hearing instruments, wherein the feature duty cycle for the respective feature corresponds to an amount of time during a period in which the respective feature is anticipated to be active; and determining, by the processing system, an energy cost for the respective feature at least based on the feature duty cycle for the respective feature and a power consumption rate of the respective feature, wherein, for at least one feature of the one or more features, the processing system determines the feature duty cycle for the at least one feature based on one or more of the answers in the questionnaire; and calculating, by the processing system, a battery life of one or more batteries in the one or more hearing instruments at least based on the energy costs for each feature of the one or more features.

2. The method of claim 1, wherein obtaining data related to the one or more hearing instruments includes obtaining, by the processing system, historical usage data of the one or more hearing instruments.

3. The method of claim 2, wherein, for at least one feature of the one or more features, determining the feature duty cycle of the feature comprises determining, by the processing system, the feature duty cycle of the at least one feature based on the historical usage data of the one or more hearing instruments.

4. The method of claim 1, wherein calculating the battery life of the one or more batteries in the one or more hearing instruments comprises:

determining, by the processing system, remaining energy for the one or more batteries in the one or more hearing instruments;

calculating, by the processing system, an energy cost for the one or more hearing instruments based on the energy cost for each feature of the one or more features; and calculating, by the processing system, the battery life of the one or more batteries in the one or more hearing instruments based on the remaining energy for the one or more batteries and the energy cost for the one or more hearing instruments.

5. The method of claim 1, further comprising:

generating, by the processing system, a power consumption report; and presenting the power consumption report.

6. The method of claim 5, further comprising:

receiving, for at least one feature of the one or more features, a user input indicating an updated feature duty cycle for the respective feature;

generating, for each feature of the at least one feature, an updated energy cost at least based on the updated feature duty cycle for the respective feature and the power consumption rate of the respective feature; and calculating, by the processing system, an updated battery life of the one or more batteries in the one or more hearing instruments at least based on the updated energy cost for each feature of the at least one feature, where the power consumption report is generated at least based on the updated battery life of the battery in the one or more hearing instruments.

7. The method of claim 1, further comprising entering into a power conservation mode based on the battery life of the one or more batteries in the one or more hearing instruments, wherein entering into the power conservation mode comprises:

determining, by the processing system, the battery life of the one or more batteries in the one or more hearing instruments is below a threshold battery life; and for at least one feature of the one or more features of the one or more hearing instruments setting the feature duty cycle to zero.

8. A computing system comprising:

one or more devices comprising one or more processors configured to:

obtain data related to one or more hearing instruments, wherein the one or more processors are configured to, as part of obtaining data related to the one or more hearing instruments, obtain data indicating answers of a user of the one or more hearing instruments to questions in a questionnaire designed to assess how much time the user expects to spend using one or more features of the one or more hearing instruments;

for each respective feature of the one or more features:

determine a feature duty cycle for the respective feature based on the data related to the one or more hearing instruments, wherein the feature duty cycle for the respective feature corresponds to an amount of time during a period in which the respective feature is anticipated to be active;

determine, an energy cost for the respective feature at least based on the respective feature duty cycle for the respective feature and a power consumption rate of the respective feature, wherein, for at least one feature of the one or more features, the one or more processors determine the feature duty cycle for the at least one feature based on one or more of the answers in the questionnaire; and calculate a battery life of one or more batteries in the one or more hearing instruments at least based on the energy costs for each feature of the one or more features.

9. The computing system of claim 8, wherein the one or more processors are configured to, as part of obtaining data related to the one or more hearing instruments, obtain historical usage data of the one or more hearing instruments.

10. The computing system of claim 9, wherein, for at least one feature of the one or more features, the one or more processors are configured to, as part of determining the feature duty cycle of the feature, determine the feature duty cycle of the at least one feature based on the historical usage data of the one or more hearing instruments.

11. The computing system of claim 8, wherein the one or more processors are configured to, as part of calculating the battery life of the one or more batteries in the one or more hearing instruments:

determine remaining energy for the one or more batteries in the one or more hearing instruments;

calculate an energy cost for the one or more hearing instruments based on the energy cost for each feature of the one or more features; and calculate the battery life of the one or more batteries in the one or more hearing instruments based on the remaining energy for the one or more batteries and the energy cost for the one or more hearing instruments.

12. The computing system of claim 8, wherein the one or more processors are further configured to:

generate a power consumption report; and present the power consumption report.

13. The computing system of claim 12, wherein the one or more processors are further configured to:

receive, for at least one feature of the one or more features, a user input indicating an updated feature duty cycle for the respective feature;

generate, for each feature of the at least one feature, an updated energy cost at least based on the updated feature duty cycle for the respective feature and the power consumption rate of the respective feature; and calculate an updated battery life of the one or more batteries in the one or more hearing instruments at least based on the updated energy cost for each feature of the at least one feature, where the power consumption report is generated at least based on the updated battery life of the battery in the one or more hearing instruments.

14. The computing system of claim 8, wherein the one or more processors are further configured to cause the one or more hearing instruments to enter into a power conservation mode based on the battery life of the one or more batteries in the one or more hearing instruments, wherein the one or more processors are configured to, as part of causing the one or more hearing instruments to enter into the power conservation mode:

determine the battery life of the one or more batteries in the one or more hearing instruments is below a threshold battery life; and for at least one feature of the one or more features of the one or more hearing instrument set the feature duty cycle to zero.

15. The computing system of claim 8, wherein the one or more devices include the one or more hearing instruments.

16. The computing system of claim 8, wherein the one or more devices include computing devices comprising one or more communication units configured to communicate with the one or more hearing instruments.

17. A non-transitory computer-readable data storage medium having instructions stored thereon that when executed cause a processing system to:

obtain data related to one or more hearing instruments, wherein the instructions that cause the processing system to obtain data related to the one or more hearing instruments include instructions that, when executed, cause the processing system to obtain data indicating answers of a user of the one or more hearing instruments to questions in a questionnaire designed to assess how much time the user expects to spend using one or more features of the one or more hearing instruments;

for each respective feature of the one or more features:

determine a feature duty cycle for the respective feature based on the data related to the one or more hearing instruments, wherein the feature duty cycle for the respective feature corresponds to an amount of time during a period in which the respective feature is anticipated to be active; and determine an energy cost for the respective feature at least based on the feature duty cycle for the respective feature and a power consumption rate of the respective feature, wherein, for at least one feature of the one or more features, the processing system determines the feature duty cycle for the at least one feature based on one or more of the answers in the questionnaire; and calculate a battery life of one or more batteries in the one or more hearing instruments at least based on the energy costs for each feature of the one or more features.

* * * * *